US005720385A

United States Patent [19]

Uchiyama

[11] Patent Number: 5,720,385

[45] Date of Patent: Feb. 24, 1998

[54] MOVABLE CONTACT PLATE OF SLIDE SWITCH

[75] Inventor: Norio Uchiyama, Tokyo, Japan

[73] Assignee: Niles Parts Co., Ltd., Japan

[21] Appl. No.: 640,131

[22] Filed: Apr. 30, 1996

[30] Foreign Application Priority Data

Sep. 8, 1995 [JP] Japan ..... 7-256818

[51] Int. Cl.[6] ..... H01H 15/06

[52] U.S. Cl. ..... 200/549; 200/275; 200/550

[58] Field of Search ..... 200/549, 547, 200/550, 252, 257, 260, 61.27, 61.28, 16 C, 16 D, 16 R, 16 A, 16 B, 558, 557, 275; 29/622

[56] References Cited

U.S. PATENT DOCUMENTS

| | | | |
|---|---|---|---|
| 3,996,431 | 12/1976 | Brown | 200/16 C |
| 4,316,067 | 2/1982 | Whiteman, Jr. | 200/260 |
| 5,038,004 | 8/1991 | Ohashi | 200/16 C |
| 5,043,540 | 8/1991 | Takano | 200/16 C |

FOREIGN PATENT DOCUMENTS 3-109237 11/1991 Japan .

*Primary Examiner*—David J. Walczak
*Attorney, Agent, or Firm*—Ronald P. Kananen

[57] ABSTRACT

A slide switch S includes a sliding member 1, a fixed contact 10 of a pole plate 7, a movable contact plate 2, a spring 12 interposed between the sliding member 1 and the movable contact plate 2, pawl portions 121, 122 formed on wall surfaces 111, 112 on both sides of the sliding member 1, and slots 41, 42 engaging with and anchoring the pawl portions 121, 122 and functioning as a guide and formed on both leg pieces 211, 212 of the movable contact plate. The movable contact plate 2 is bent and expanded outward on the side of an end portion 221 of the leg piece 211 with respect to the portion where the slot 41 is formed. This slide switch construction eliminates damage between the movable contact plate of the slide switch and the pawl portions engaging with, and anchoring, the movable contact plate, and results in a smoother operation of the switch.

7 Claims, 3 Drawing Sheets

MOVABLE CONTACT PLATE OF SLIDE SWITCH

BACKGROUND OF THE INVENTION

1. Field of the Invention

This invention relates generally to switches for automobiles and, in particular, to a movable contact plate of a slide switch of the type wherein a movable contact plate disposed on a sliding member comes into and out of contact with a fixed contact of a pole plate when a knob is manually operated.

2. Description of the Related Art

A conventional automotive slide switch is disclosed, for example, in Japanese Utility Model Laid-Open No. 3-109237 (1991). This conventional slide switch includes a sliding member that moves inside a case when a knob is manually operated, a U-shaped movable contact plate made of an electrically conductive thin metal plate and capable of coming into and out of contact with a fixed contact of a pole plate, and a spring housed in a cylinder portion formed in the sliding member and interposed between the sliding member and the movable contact plate. Pawl portions are formed on both side wall surfaces of the sliding member. Slots that are engageable with and lockable by the pawl portions and serve also as a guide are formed in both legs of the movable plate, respectively. Both leg pieces of this movable contact plate extend straight upwardly.

This conventional slide switch assembly operates as follows. When the knob is manually operated, the sliding member moves against the force of the spring and, at the same time, the pawl portions of the sliding member are guided into the slots of the movable contact plate and bring the movable contact plate into contact with the fixed contact of the pole plate. Consequently, the switch can be brought into a closed state. The assembling work of the slide switch of the prior art is sped up, and the structure thereof is simplified by the pawl portions of the sliding member being engageable with the slots of the movable contact plate.

However, because both leg pieces of the movable contact plate of the slide switch according to the prior art extend straight upwardly, both leg pieces are strongly pushed in such a manner as to expand by the slant surfaces of the pawl portions when the sliding member and the movable contact plate are assembled. Accordingly, the pawl portions of the sliding member move on the inner wall surface from the distal end of both leg pieces to the slots while strongly pressing the inner wall surface, and either or both of the leg pieces and the pawl portions are shaved. The shaved thin portions cannot engage after the assembly and the movable contact plate deviates from the sliding member. Thus, a problem that the slide switch cannot fulfill the function as a switch arises.

SUMMARY OF THE INVENTION

An object of the present invention is to solve the problems associated with the aforementioned conventional switch assembly.

More specifically, it is an object of the present invention to eliminate damage to the movable contact plate of the slide switch and the pawl portions that is engageable with and lockable by the movable contact plate, and to make the switch operation smooth.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the objects of the invention, a slide switch is provided that includes a sliding member, a fixed contact of a pole plate, a movable contact plate, a spring interposed between the sliding member and the movable contact plate, pawl portions formed on both side wall surfaces of the sliding member, and slots engageable with and lockable by the pawl portions. The slots serve as a guide and are formed in both leg pieces of the movable contact plate. The end portions of both leg pieces of the movable contact plate are bent and expanded outwardly. Preferably, the portions of the leg pieces where the slots are formed are bent and expanded outwardly.

In a further aspect of the present invention, in accordance with its objects and purposes, the invention may comprise a slide switch including a sliding member having pawl portions formed on first and second side wall surfaces of the sliding member, a movable contact plate having first and second upstanding leg pieces and slots formed in the first and second leg pieces, the slots being engageable with the pawl portions and serving as a guide for the sliding member, an end portion of the first leg piece of the movable contact plate being offset outwardly, and a spring interposed between the sliding member and the movable contact plate.

It is also prefered that the slot of the slide switch is formed in a portion of the first leg piece containing the outward offset of the end portion of the first leg piece, and that the first leg piece comprises an upstanding base portion, an intermediate portion angled outwardly from the upstanding base portion, and the end portion extending upwardly from the intermediate portion, with the slot formed in the first leg piece extending through the upstanding base portion, the intermediate portion, and the end portion.

The pawl portion formed on the first side wall surface of the sliding member preferably has a tapered lower surface for engaging the first leg piece during assembly. The upper end portion of the first leg piece is preferably chamfered.

BRIEF DESCRIPTION OF THE DRAWINGS

The present invention will become more clearly appreciated as a description of the invention is made with reference to the accompanying drawings. In the drawings.

DETAILED DESCRIPTION OF THE PREFERRED EMBODIMENT

A preferred embodiment of a slide switch S according to the present invention will be described in detail hereinafter with reference to FIGS. 1 to 5 of the accompanying drawings.

Figure 1:
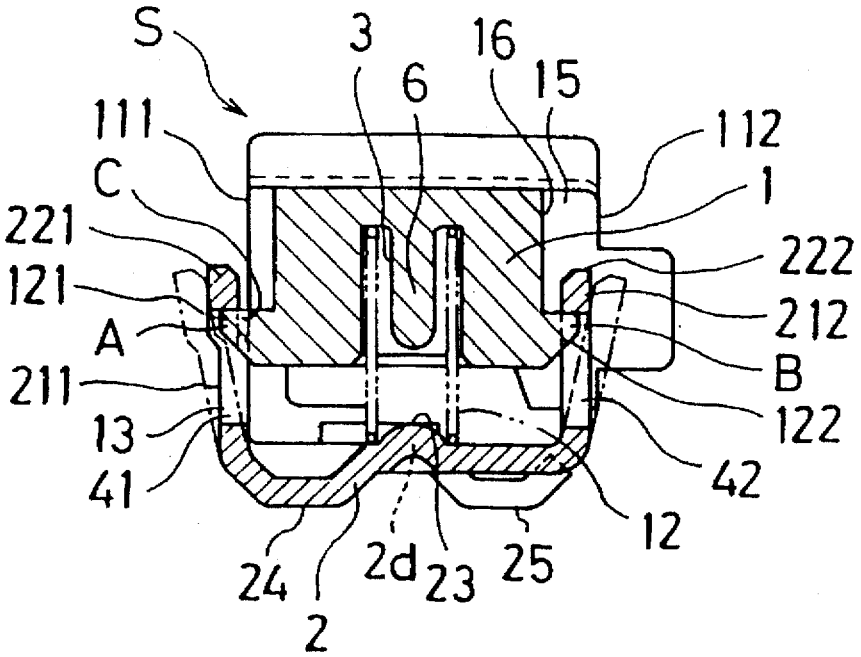
FIG. 1 is a sectional view of principal portions before a sliding member is assembled into a slide switch according to the present invention.
Figure 2:
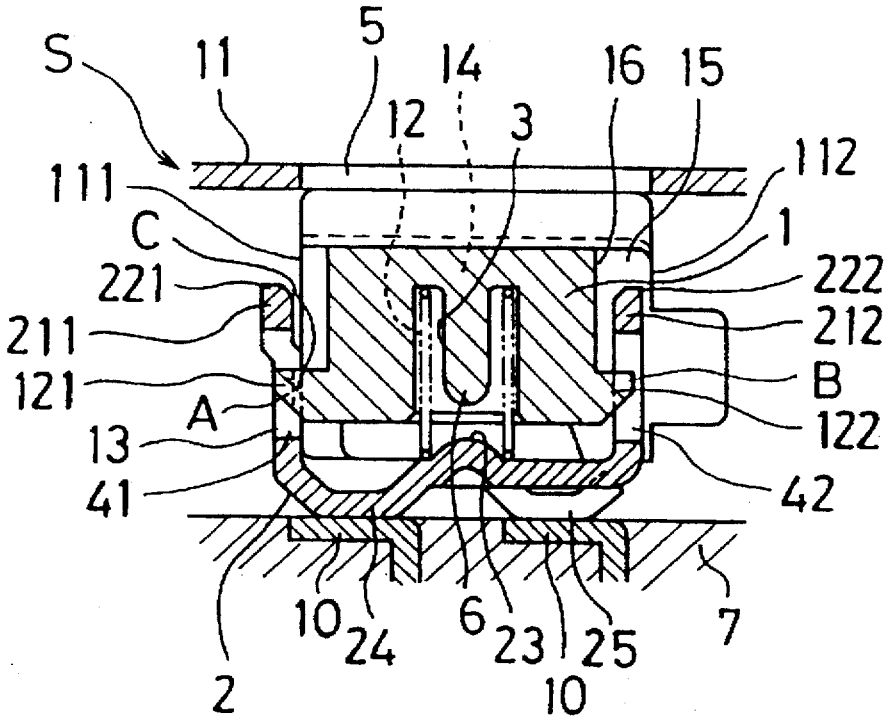
FIG. 2 is a sectional view of principal portions when the sliding member is assembled into the slide switch according to the present invention.
Figure 3:
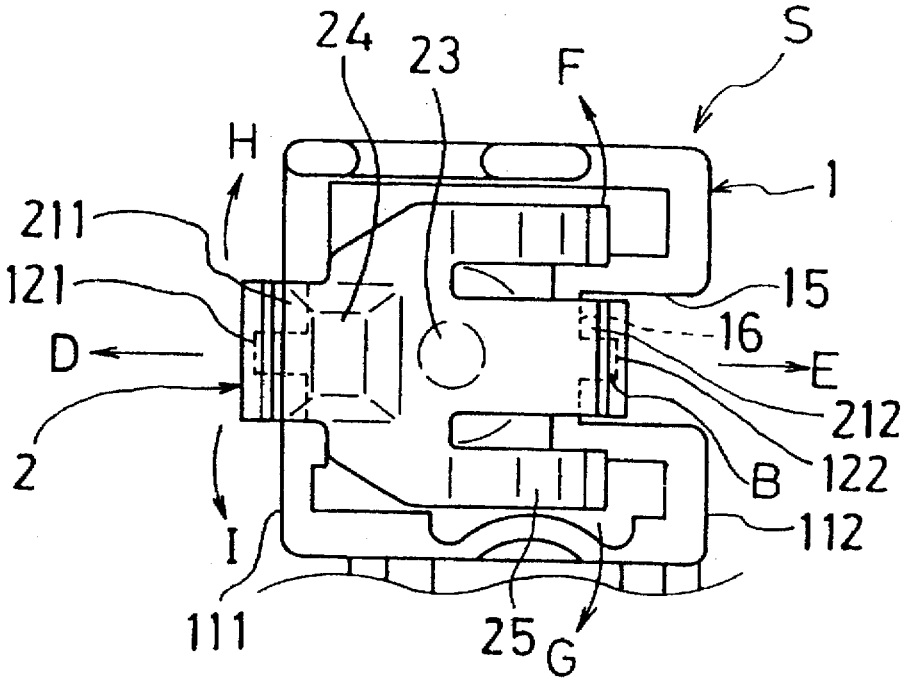
FIG. 3 is a partly sectional bottom view of the sliding member according to the present invention.
Figure 4:
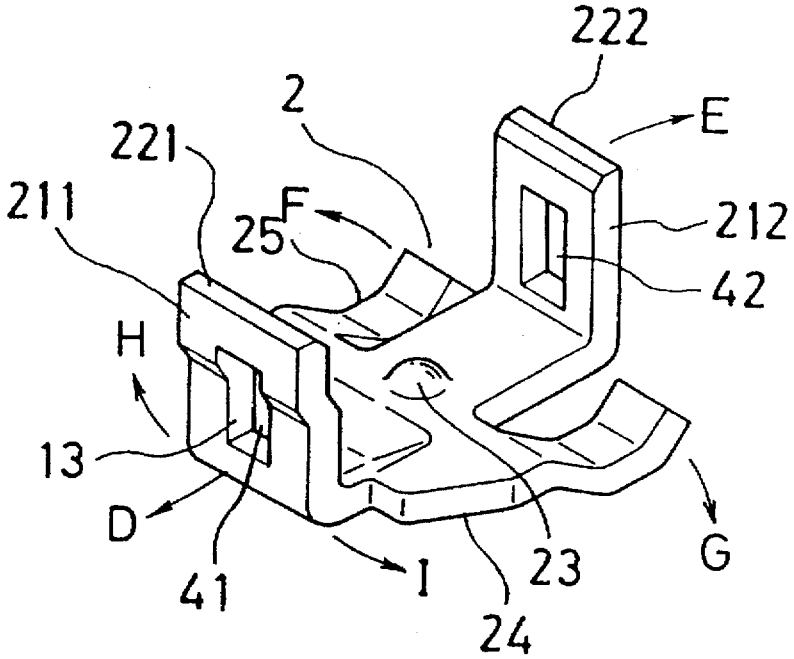
FIG. 4 is an enlarged perspective view of a movable contact plate in the present invention.
Figure 5:
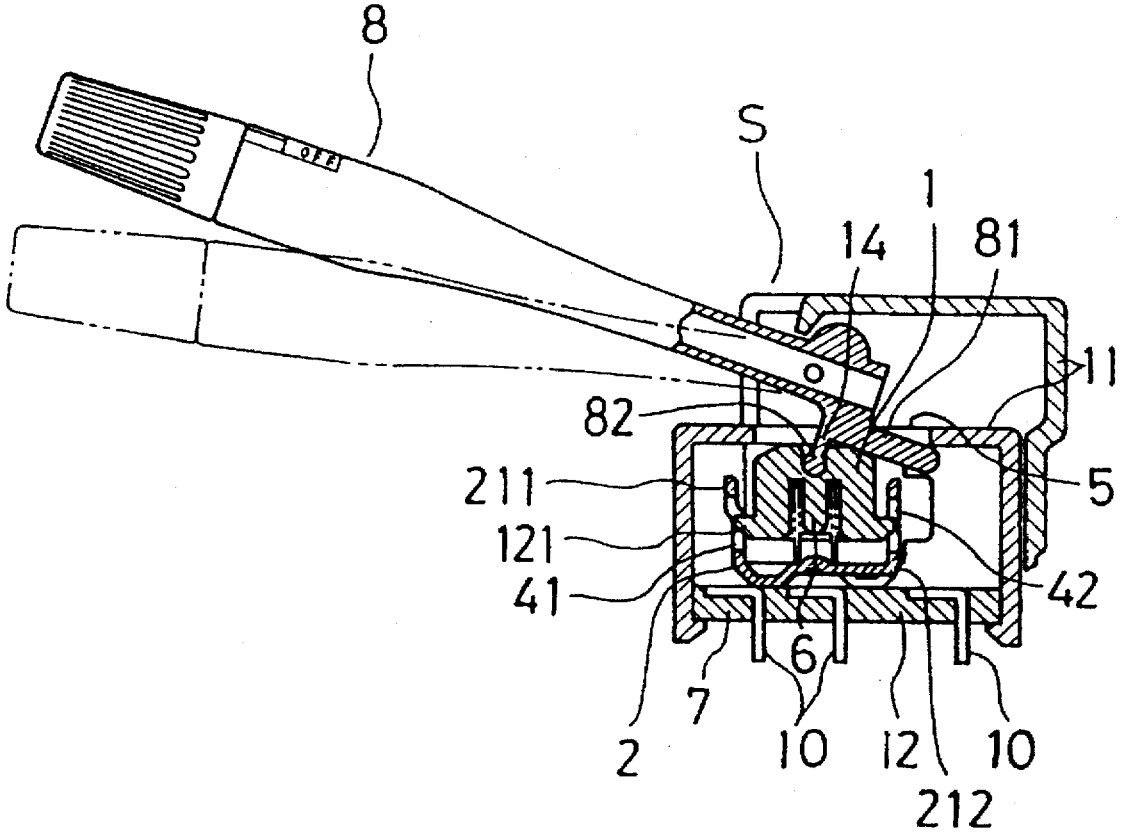
FIG. 5 is an explanatory view of the slide switch according to the present invention.

In the drawings, symbol S represents a slide switch. FIG. 1 is a sectional view of principal portions before a sliding member 1 is assembled into the slide switch S, and FIG. 2 is a sectional view when the sliding member 1 is assembled into the slide switch S. FIG. 3 is a bottom view of the sliding member 1, FIG. 4 is a perspective view of a movable contact plate 2, and FIG. 5 is an explanatory view of an embodiment of the slide switch S in which the sliding member 1 is assembled.

The movable contact plate 2 of the slide switch S according to the present invention will be explained with reference to FIG. 1. As described above, FIG. 1 shows the section before the slide switch S is completely assembled. The slide switch S includes the sliding member 1, a fixed contact 10 of a pole plate 7, the movable contact plate 2, and a spring 12 interposed between the sliding member 1 and the movable contact plate 2. Further, pawl portions 121 and 122 are formed on both side walls 111, 112 of the sliding member 1, respectively. Slots 41, 42, which are engageable with and lockable by the pawl portions 121, 122 and serve as guides, are formed on both leg pieces 211, 212 of the movable contact plate 2, respectively. In the slide switch S having such a construction, the end portion 221 of the leg piece 211 of the movable contact plate 2 is bent and expanded outward, and the portion of the leg piece 211 of the movable contact plate 2, where the slot 41 is formed, is bent and expanded outward.

The slide switch S according to the present invention uses the slide member 1 for locking the movable contact plate 2, which slides on the pole plate 7. The slide switch S is a so-called "lever switch" of the type in which the sliding member 1 is caused to slide by an operation lever 8, as shown in FIG. 5. Alternatively, the slide switch S may use a push button switch, a push-push switch, a slide switch, a pull-push switch, a rotary switch, a lever switch, a seesaw switch, and so forth, for the mechanism of the operation portion so long as the sliding member 1 slides with respect to the pole plate 7.

Hereinafter, a lever switch of one embodiment of the present invention will be described in further detail. The sliding member 1 is interposed movably and slidably between the case 11 and the pole plate 7, as shown in FIGS. 2 and 5. The case 11 has an opening 5 that is formed in the upper part of its center and through which an operation rod 81 of the operation lever 8 penetrates. The sliding member 1 is equipped at the center of the upper surface thereof with an engagement hole 14 into which a distal end shaft 82 of the operation rod 81 is fitted. A cylinder portion 3 for fitting the spring 12 is formed at the position of the sliding member 1 opposing the center of the lower surface of the movable contact plate 2. Further, the sliding member 1 has the engagement portions 121, 122 engaging with the slots 41, 42 of the right and left side surfaces and movable vertically inside these slots.

The movable contact plate 2 comprises a substantially U-shaped contact plate, as shown in FIGS. 1 and 2. The slots 41, 42 with which the pawl portions 121, 122 of the sliding member 1 engage vertically movably are formed in the right and left leg pieces 211, 212 of the movable contact plate 2. One of the leg pieces 211 is expanded outward at a substantial center of the slot 41. The other leg piece 212 engages with the guide groove 16.

Alternatively, both leg pieces 211, 212 of the movable contact plate 2 may be expanded outwardly. The pawl portion 121 engaging with the slot 41 has a protruding portion that 20 protrudes above the other pawl portion 122 by a distance corresponding to the thickness of the movable contact plate 2.

A shaft 6 to which the spring 12 loosely fits is formed at the center of the inside of the cylinder portion 3 described already. This spring 12 is a contact spring comprising a coil spring, and presses the movable contact plate 2 to the pole plate 7 and the sliding member 1 to the inner ceiling of the case 11. The lower end of the spring 12 fits to a protruding portion 23 that spherically protrudes from the center of the movable contact plate 2. The shaft 6 and the protruding portion 23 together prevent the spring 12 fitted into the cylinder portion 3 from being bent and coming off from the cylinder portion 3 when the sliding member 1 slides.

The movable contact plate 2 is made of an electrically conductive thin metal and is a copper blank. Though the movable contact plate 2 has a slight flexibility, it does not have a large returning force. Therefore, when the movable contact plate 2 is assembled to the sliding member 1, the sliding member 1 is pushed from the side of the end portions 221, 222 of the movable contact plate 2 through the spring 12, as shown in FIG. 1. During this push operation, the slope formed on the pawl portions 121, 122 of the sliding member enters while coming into contact with the leg pieces 211, 212 of the movable contact plate 2. Consequently, there arises a problem that the inner wall surface of the movable contact plate 2 on the side of its end portions 221, 222 and the pawl portions 121, 122 of the sliding member 1 are shaved and worn out, and the pawl portions 121, 122 fail to engage with the slots 41, 42.

The shaved portions A, B of the pawl portions 121, 122, shaved by the leg pieces 211, 212 are substantially the whole portions of the pawl portions 121, 122 where the leg pieces 211, 212 are bonded to them, as shown in FIGS. 1 and 2. In consequence, the pawl portions 121, 122 do not engage with the inner wall at the upper part of the slots 41, 42 and become liable to come off. However, because the leg piece 211 is expanded outward in the present invention, the shaved quantity of the shaved portion A of the leg pieces 211, 212 is smaller than that of the shaved portion B of the leg piece 212 by the quantity of the guide portion C.

When the sliding member 1 having the movable contact plate 2 assembled thereto, as shown in FIG. 1, is assembled between the case 11 and the pole plate 7, the movable contact plate 2 is pressed to the pole plate 7, as shown in FIG. 2, and the pawl portions 121, 122 are positioned at the center of the slots 41, 42. The movable contact plate 2 is biased by the spring 12 and is brought into pressure contact with the pole plate 7. The sliding member 1 is biased by the spring 12 and is brought into pressure contact with the case 11.

When the operation lever 8 shown in FIG. 5 is operated upward, for example, the sliding member 1 moves in the direction D, and the movable contact plate 2 comes into contact with the fixed contact 10 and turns it on. At this time, because the movable contact plate 2 engages with the sliding member 1 while keeping its generally U-shaped form as a whole, the movable contact plate 2 does not deviate or come from the sliding member 1.

When the operation lever 8 is operated downward, the sliding member 1 together with the movable contact plate 2 moves in the direction indicated by an arrow E, and contacts 24 and 25 of three contacts come into contact with the fixed contact 10 and turn it on. Since these contacts 24 and 25 are formed at the lower end positions of the movable contact plate 2, the rotating force acts at this time with the protruding portion 23 at the center of the movable contact plate 2. When the force in the direction indicated by an arrow F or G acts on the leg piece 212, as shown in FIG. 3, for example, the leg piece 212 comes into contact with the side wall 15 of the guide groove 16 and prevents the leg piece 212 from deviating in the directions F and G. In this way, a contact failure caused by the leg piece 2 moving and deviating in the directions F and G, thereby causing the contacts 24, 25 to not come into contact with the fixed contact 10, can be prevented.

When the rotating force whose rotation center is at the protruding portion 23 acts on the movable contact plate 2, the leg piece 211 moves in the direction H or I, as shown in FIG. 3. The guide portion C of the pawl portion 121 comes into contact with the inner side wall 13 of the slot 41. Accordingly, the problem of the leg piece 221 moving in the direction H or I and deviating from a normal position, and a contact failure being caused by the contacts 24, 25 not coming into contact with the fixed contact 10 can be prevented.

As described above, in a slide switch of the type that includes a sliding member moved by an operation lever, a U-shaped movable contact plate made up of an electrically conductive thin metal plate and capable of coming into and out of contact with a fixed contact of a pole plate, a spring interposed between the sliding member and a movable contact plate, leg pieces formed on the side wall of both sides of the sliding member and slots engageable with and lockable by the pawl portions, the slots serving as a guide and being formed in both leg pieces of the movable contact plate, the present invention provides a slide switch wherein the end portion of at least one leg piece of the movable contact plate is bent and expanded outward, and preferably, the portion of the at least one leg piece of the sliding member where the slot is formed is bent and expanded outward.

Therefore, when the movable contact plate is assembled to the sliding member, the quantity of shaving of the pawl portion by the leg pieces of the movable contact plate can be reduced by a half. Therefore, the movable contact plate can solve the problem that when the force acts in the orthogonal direction to the movement direction of the moving member, the pawl portions come into contact with the inner side wall of the slot and, consequently, the movable contact plate deviates and fails to come into contact with the fixed contact. Moreover, because the operation of the switch can be made smooth, the quality and usefulness of the switch can be improved.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

We claim:

1. A slide switch comprising:

a sliding member;

a fixed contact of a pole plate;

a movable contact plate;

a spring interposed between said sliding member and said movable contact plate;

pawl portions formed on first and second side wall surfaces of said sliding member; and said movable contact plate having first and second leg pieces each having a slot formed therein, said slots being engageable with and lockable by said pawl portions and serving as a guide for movement of said sliding member relative to said movable contact plate;

wherein a portion of said at least one leg piece of said movable contact plate where said slot is formed is bent outward and expanded.

2. A slide switch, comprising:

a sliding member having pawl portions formed on first and second side wall surfaces of said sliding member;

a movable contact plate having first and second upstanding leg pieces and slots formed in said first and second leg pieces, said slots being engageable with said pawl portions and serving as a guide for movement of said sliding member relative to said movable contact plate, an end portion of said first leg piece of said movable contact plate and an intermediate portion of said first leg piece where at least a portion of said slot is formed being offset outwardly; and a spring interposed between said sliding member and said movable contact plate.

3. A slide switch according to claim 2, wherein said first leg piece comprises an upstanding base portion, said intermediate portion where at least a portion of said slot is formed being angled outwardly from said upstanding base portion, and said end portion extending upwardly from said intermediate portion.

4. A slide switch according to claim 3, wherein the slot formed in said first leg piece extends through said upstanding base portion, said intermediate portion, and said end portion.

5. A slide switch according to claim 2, wherein first and second contacts are formed on a lower side of said movable contact plate.

6. A slide switch according to claim 2, wherein the pawl portion formed on the first side wall surface of said sliding member has a tapered lower surface for engaging said first leg piece during assembly.

7. A slide switch according to claim 6, wherein the end portion of said first leg piece is chamfered at a location spaced from said outwardly angled intermediate portion.

* * * * *